United States Patent [19]

Endres et al.

[11] Patent Number: 4,537,281

[45] Date of Patent: Aug. 27, 1985

[54] TWO PERSON AERIAL PLATFORM

[75] Inventors: Douglas W. Endres, Lexington; Kenneth D. McDaniel, Jr., Midway; Francis J. Griebel, Lexington, all of Ky.

[73] Assignee: FMC Corporation, Chicago, Ill.

[21] Appl. No.: 659,141

[22] Filed: Oct. 9, 1984

[51] Int. Cl.[3] ..... B66F 9/06; B66F 11/04; G06C 7/16

[52] U.S. Cl. ..... 182/2

[58] Field of Search ..... 182/2, 129, 222

[56] References Cited

U.S. PATENT DOCUMENTS

| | | | |
|---|---|---|---|
| 2,672,377 | 3/1954 | Werner | 182/2 |
| 3,690,408 | 9/1972 | Reske | 182/2 |
| 3,741,337 | 6/1973 | Visinky | 182/2 |
| 4,314,622 | 2/1982 | Lindquist | 182/2 |
| 4,449,611 | 5/1984 | Frey-Wigger | 182/2 |

FOREIGN PATENT DOCUMENTS

| | | | |
|---|---|---|---|
| 2249311 | 4/1974 | Fed. Rep. of Germany | 182/2 |
| 2328990 | 12/1974 | Fed. Rep. of Germany | 182/2 |
| 1440874 | 6/1974 | United Kingdom | 182/2 |

*Primary Examiner*—Reinaldo P. Machado
*Attorney, Agent, or Firm*—Richard B. Megley; Ronald C. Kamp

[57] ABSTRACT

This invention relates to aerial platforms capable of accommodating two occupants, and more particularly, to such devices which are especially suited for use with a hydraulic crane.

3 Claims, 5 Drawing Figures

TWO PERSON AERIAL PLATFORM

This application is related to patent application Ser. No. 597,010, filed Apr. 5, 1984 by Kenneth D. McDaniel, Jr., Douglas W. Endres and Francis J. Griebel and entitled Hydraulic Crane Aerial Platform Attachment.

The present invention provides a structure which may be easily and quickly attached to, and detached from, the head machinery of a hydraulic crane, which is stable, which accommodates at least two persons permitting a relatively unobstructed work space throughout virtually the entire range of movement of the crane, and which securely retains the occupants while permitting ready ingress to, and egress from the platform's basket.

These attributes and other advantages and features of the present invention will become more readily apparent from a perusal of the following description of the best mode for practicing the invention and the accompanying drawings, wherein.

Figure 1:
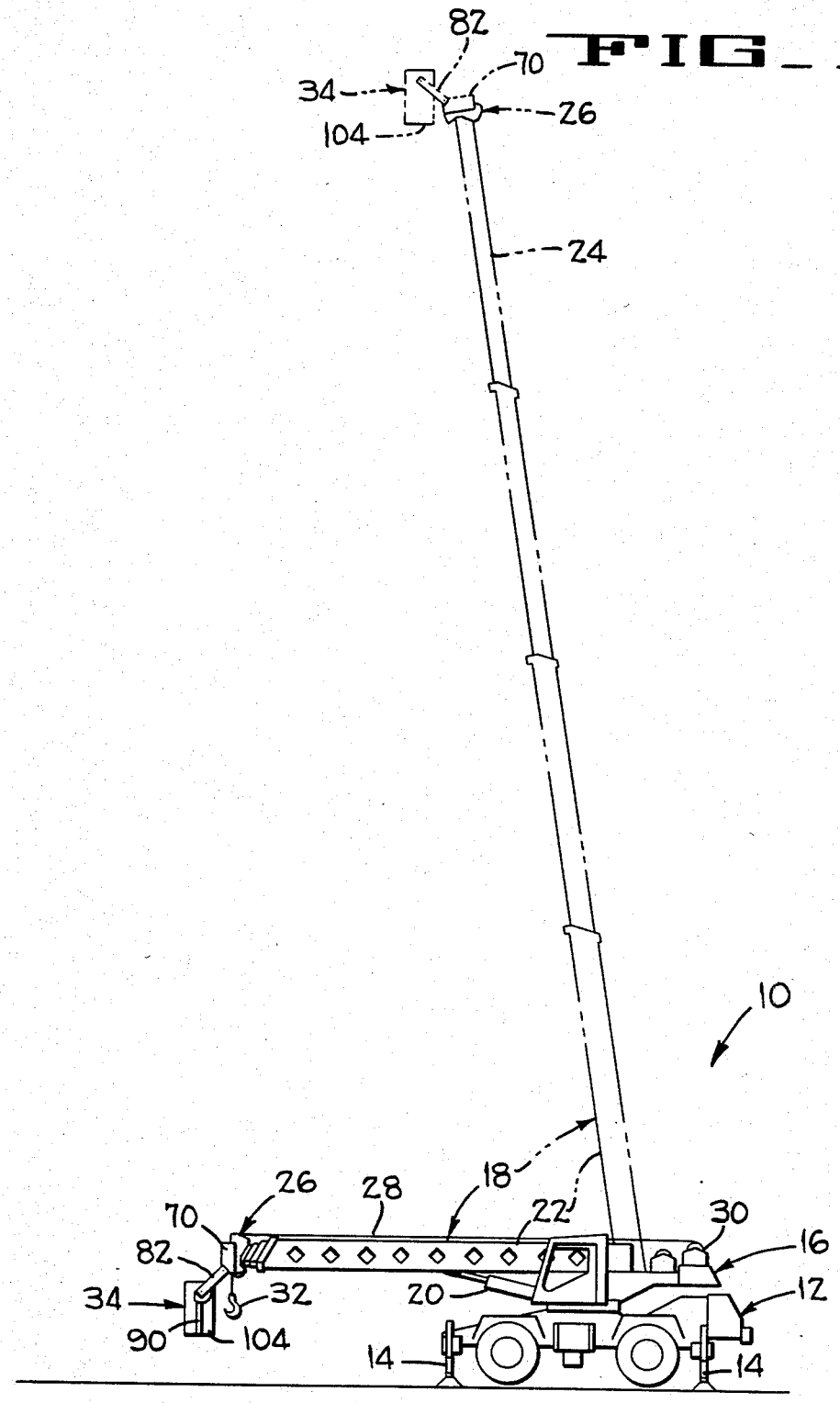
FIG. 1 is a side elevational view of a hydraulic crane incorporating an aerial platform according to the present invention.

Referring now to FIG. 1, there is shown a conventional hydraulic crane, indicated generally at 10, having a wheeled lower 12, which is shown in a lifting configuration with outrigger jacks 14 carried by the lower supporting the crane for improved stability, and an upper 16 rotatably mounted on the lower 12 for swinging of the upper about a vertical axis relative to the lower. A boom 18 is pivotally attached to the upper 16 with a pair of boom cylinders, one of which is shown at 20, connected between the boom and the upper to control the angle of the boom between an essentially horizontal position as shown by solid lines in FIG. 1 and a nearly vertically position as shown in phantom. As will be apparent from FIG. 1, the boom 18 is typically composed of multiple sections which are collapsible as shown by solid lines and extendable as shown by phantom lines. The multiple section of the boom 18 include a base section 22, which is the section pivotally attached to the upper 16, and a tip section 24 to which the head machinery 26 is mounted. At least one wire rope, such as 28, is wound on and extends from a winch 30 attached to the upper to the head machinery and has a hook 32 secured to its free end.

Figure 3:
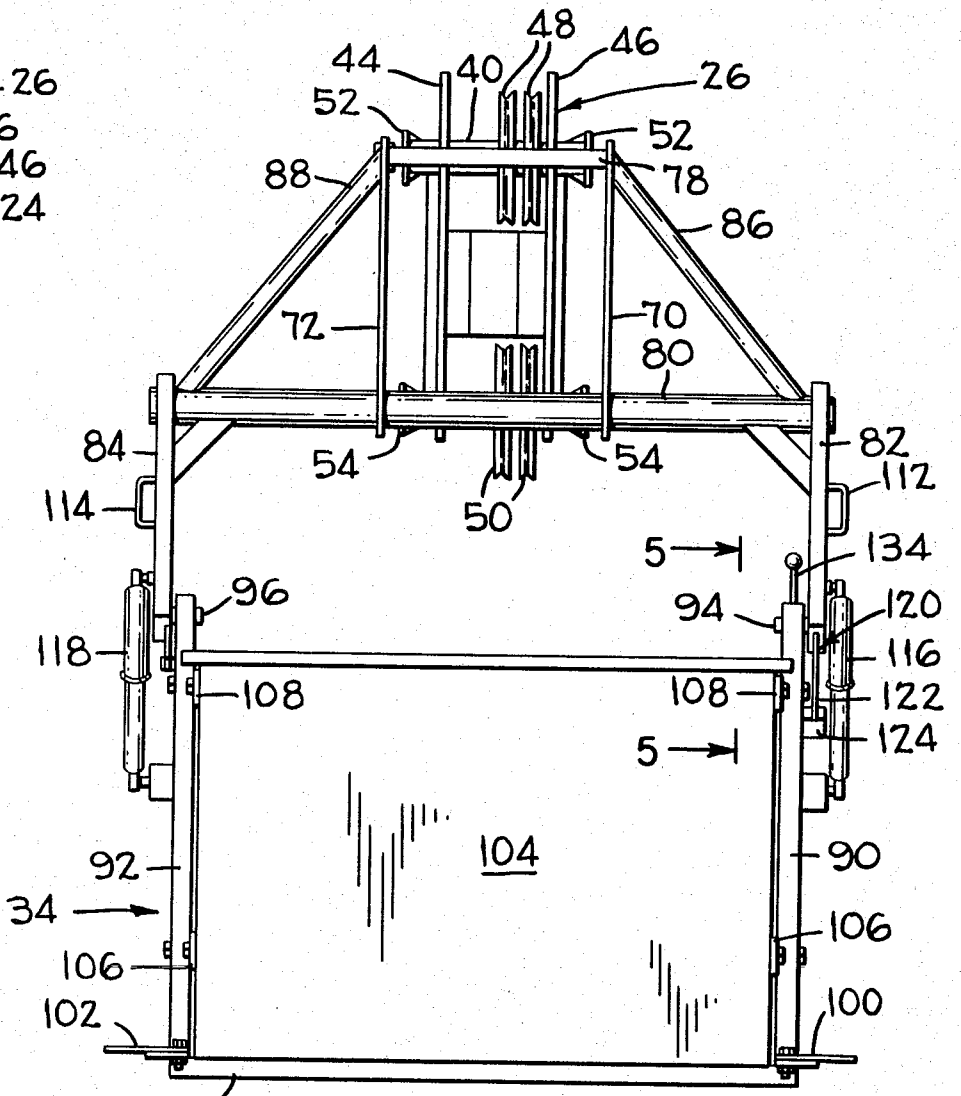
FIG. 3 is a front elevational view of the aerial platform shown in FIG. 2.
Figure 2:
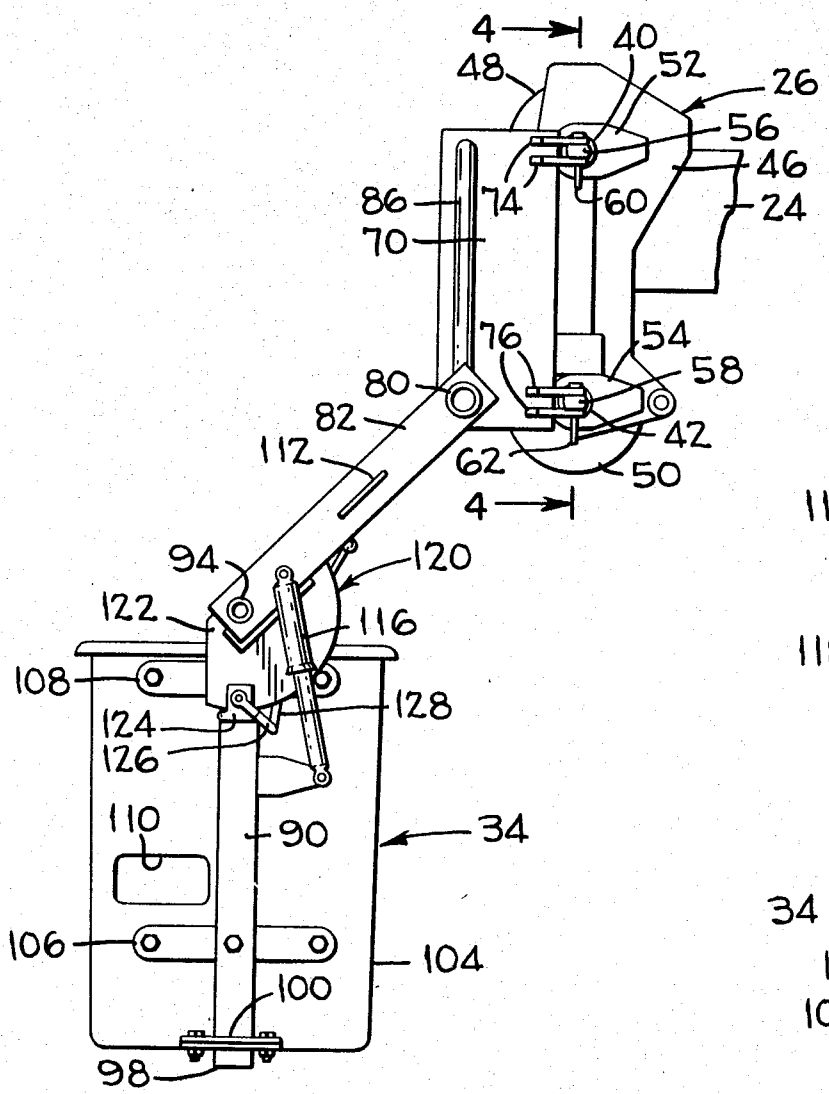
FIG. 2 is a side elevational view of the aerial platform shown in FIG. 1.
Figure 4:
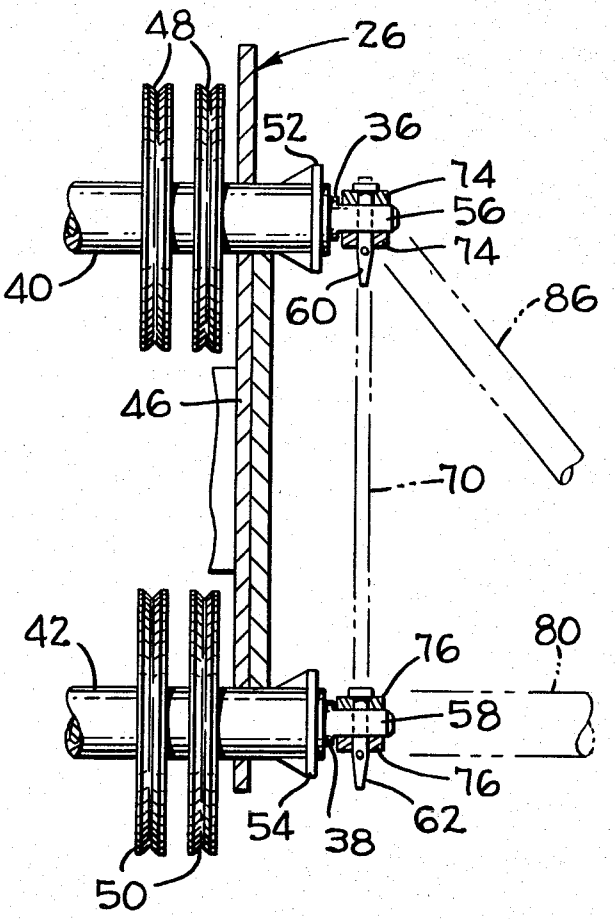
FIG. 4 is a cross-sectional view taken on line 4—4 of FIG. 2 with portions of the platform shown in phantom.

An aerial platform, indicated generally at 34 and best shown in FIGS. 2 and 3, is capable of being detachably secured to the head machinery 26. The points of attachment to the head machinery 26 are the same as those used for attachment of a conventional fly. As shown in FIG. 4, the head machinery 26 includes a pair of solid shafts 36 and 38 which are non-rotatably secured inside tubes 40 and 42 respectively, which tubes span, and are attached to side plates 44 and 46 of the head machinery 26. Sheaves 48 and 50 are rotatably mounted on the tubes 40 and 42 respectively. Each end of the tubes 40 and 42 are provided with a rigid collar 52 and 54 respectively. Both ends of each shaft 36 and 38 are milled to provide mounting lugs 56 and 58. The upper and lower surfaces of each lug are parallel to each other and to the other lug surfaces. These four lugs are each drilled perpendicular to their flat surfaces to accept anchor pins, such as those shown at 60 and 62. The head machinery just described is conventional and is provided for an understanding of the attachment of the aerial platform 34 to the head machinery 26.

The aerial platform 34 has a pair of base plates 70 and 72, each plate having two sets of mounting ears; the ears on the plate 70 being shown in FIG. 2 at 74 and 76. The inner surfaces of each set of ears are parallel and spaced apart to tightly engage the corresponding lug, such as is illustrated by the ear sets 74 and 76 engaging the lugs 56 and 58 respectively. Each of the ear sets are drilled to accept the anchor pins, such as pins 60 and 62, (Note FIGS. 2 and 4) in order to anchor the base plates 70 and 72 to the head machinery 26. A cross tube 78 is secured between the upper, as viewed in FIGS. 2 and 3, ends of the plates 70 and 72. A beam 80, which preferrable is circular in cross-section, extends through and is secured to each of the plates 70 and 72. The cross tube 78, the two plates 70 and 72 and that portion of beam 80 extending between the plates form a rigid box structure, and with the attachment of the ear sets to the lugs, constitute a rigid and stable base for suspension of the remainder of the aerial platform structure.

The beam 80 extends a equal distance beyond each of the plates 70 and 72, and sufficient to accomodate the width of personnel basket desired. Suspension arms 82 and 84 are secured to and cantilevered from opposite ends of the beam 80. Braces 86 and 88 extend between the plates 70 and 72 respectively and near the corresponding end of the beam 80; the braces 86 and 88 having their attachment to the plates 70 and 72 substantially aligned with cross tube 78. These braces 86 and 88 improve the strength and rigidity; the latter by reducing the deflection of the ends of the beam 80. Cross braces 86 and 88 are provided between the beam 80 and the arms 82 and 84 respectively to provide rigidity to the suspension arms 82 and 84 and to resist side loads imposed thereon.

Stanchions 90 and 92 are pivotally attached to the free ends of the arms 82 and 84 by pivot pins 94 and 96 respectively. A cross member 98 is secured to and extends between the lower ends of the stanchions 90 and 92. Step plates 100 and 102 are attached to the intersection of the cross member 98 with the stanchions 90 and 92 and project outward from the associated stanchion. A fiberglass basket 104 rests on the cross member 98 and is secured to the stanchions 90 and 92. Perpendicular straps, such as shown at 106 and 108, are secured to the stanchions and to the basket 104 to distribute the loading on the fiberglass basket. A rectangular opening, as shown at 110, is provided in each end of the basket 104 adjacent the stanchions 90 and 92. The edge of the opening functions as a step to facilitate ingress and egress of personnel, as do the step plates 100 and 102. Grab handles 112 and 114 are attached to the outer surfaces of the suspension arms 82 and 84 serve to assist personnel in maintaining their balance during the aforementioned ingress and egress.

It should be noted that the suspension arms 82 and 84 are oriented at the same angle with regard to the horizontal. It has been found that utilization of approximately 45 degrees for this angle and an arm length sufficient for that rear edge of the basket to be positioned approximately 6 inches forward of the plates 70 and 72 when the boom is fully lowered will minimize possible contact between personnel in the basket and the beam 80 and/or the head machinery 26 as the boom is raised to an elevated position.

Figure 5:
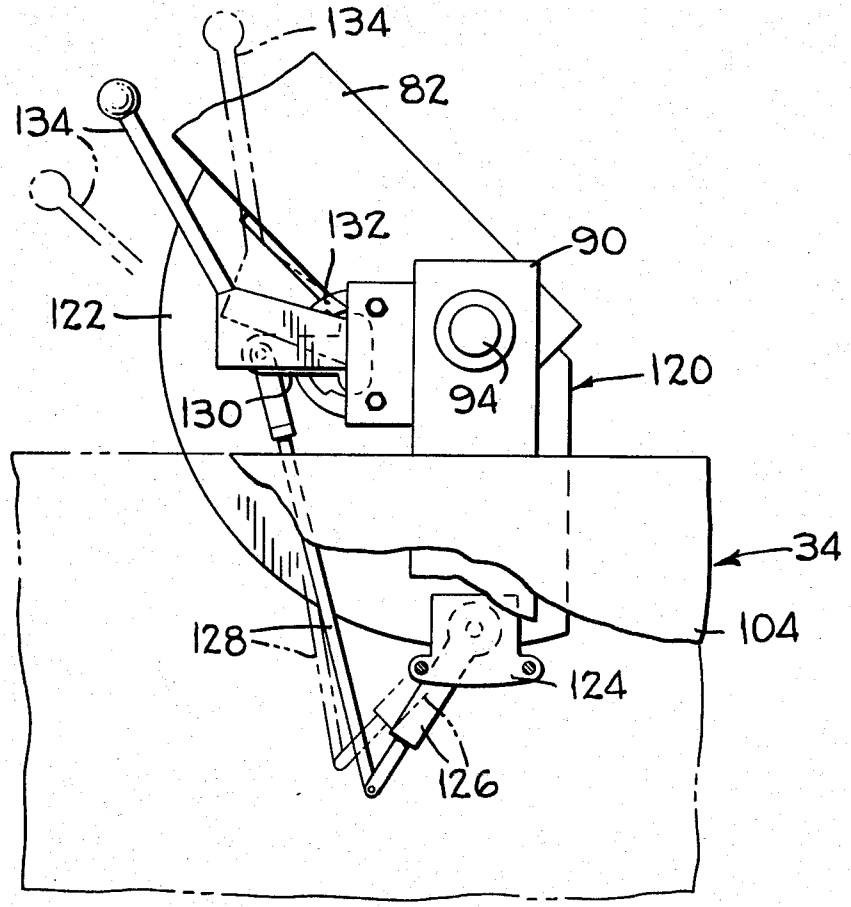
FIG. 5 is a cross-sectional view taken on line 5—5 of FIG. 3 showing the brake mechanism.

In order to prevent fast rotation of the basket 104 about the pins 94 and 96 as a result of a sudden unbalancing movement by personnel in the basket during pivotal elevation of the boom 18, a pair of dash pots or shock absorbers 116 and 118 are connected between each arm and a bracket attached to the adjacent stanchion. After the boom 18 is positioned at the desired angle, it is necessary to lock the basket 104 so that it will not rotate about the axis of pins 94 and 96. A manually actuated brake 120 is provided for this purpose. As best seen in FIG. 5, a disk brake rotor 122, which need extend only approximately 135 degrees, is attached to the suspension arm 82 with its center coincident with the axis of pin 94. A brake caliper 124 is attached to the stanchion 90 and is actuated by rotation of a lever 126; being disengaged in the solid line position and engaging the rotor 122 when the lever is positioned on either side of the solid line position, such as indicated in phantom lines. The lever 126 is connected by link 128 to the output lever 130 of a one-way control 132, such as a Quadrastat control. A handle 134 is connected to the input of control 132. When the handle 134 is positioned as shown in solid lines, the brake 120 is released and the basket 104 may rotate relative to the arms 82 and 84, but at a slow rate determined by the dash pots 116 and 118. This mode is used to permit the basket to remain level as the boom is pivoted to a raised position. Once the boom is raised, the handle 134 is moved to either of its phantom line positions to apply the brake and thereby lock the basket to the arm. Personnel are, thereafter, free to work from the basket without any rotation of the basket on the suspension arms.

While one embodiment of the present invention has been illustrated and described herein, various modifications and changes may be made therein without departing from the spirit of the invention as defined by the scope of the appended claims.

What is claimed is:

1. An aerial platform for attachment to the head machinery of a hydraulic crane, said machinery having a pair of mounting lugs extending from each side thereof, said platform comprising:

a pair of base plates, each plate having a pair of mounting ears complementary to and engageable with said lugs;

a cross tube attached at each end to said base plates;

a beam extending beyond and secured to said base plates;

a pair of braces, each brace attached to and extending between one of said base plates and the adjacent end of said beam;

a pair of suspension arms, each arm attached to one end of said beam and extending outward from said base plates at an obtuse angle; and a personnel basket pivotally attached to the free ends of said arms.

2. The invention according to claim 1, and further comprising:

a brake connected between said arm and said basket to selective lock said basket relative to said arms.

3. The invention according to claim 2, and further comprising:

a dash pot connected between each arm and said basket to control the rate of movement of said basket relative to said arms.

* * * * *